US008763536B2

(12) United States Patent
Sakanoue et al.

(10) Patent No.: US 8,763,536 B2
(45) **Date of Patent: *Jul. 1, 2014**

(54) TRUCK LATERAL MOTION RESTRICTING DEVICE

(75) Inventors: Kei Sakanoue, Nagoya (JP); Yoshinori Minami, Nagoya (JP); Masahito Adachi, Nagoya (JP); Hironobu Sunami, Nagoya (JP); Nobuhisa Takada, Nagoya (JP); Toru Konokawa, Nagoya (JP)

(73) Assignees: Central Japan Railway Company, Nagoya-Shi (JP); Nippon Sharyo, Ltd., Nagoya-Shi (JP)

( * ) Notice: Subject to any disclaimer, the term of this patent is extended or adjusted under 35 U.S.C. 154(b) by 160 days.

This patent is subject to a terminal disclaimer.

(21) Appl. No.: 13/266,348

(22) PCT Filed: Apr. 22, 2010

(86) PCT No.: PCT/JP2010/057133

§ 371 (c)(1), (2), (4) Date: Oct. 26, 2011

(87) PCT Pub. No.: WO2010/125963

PCT Pub. Date: Nov. 4, 2010

(65) Prior Publication Data

US 2012/0037715 A1 Feb. 16, 2012

(30) Foreign Application Priority Data

Apr. 30, 2009 (JP) ..... 2009-110619

(51) Int. Cl.
*E01B 5/00* (2006.01)
*B61F 9/00* (2006.01)

(52) U.S. Cl.
USPC ..... 105/216; 104/242; 238/17

(58) Field of Classification Search
USPC ..... 104/242; 105/216; 238/17, 19, 20
See application file for complete search history.

(56) References Cited

U.S. PATENT DOCUMENTS 187,761 A * 2/1877 Johnson ..... 104/243
735,239 A * 8/1903 Gehricke et al. ..... 105/216

(Continued)

FOREIGN PATENT DOCUMENTS

CN 101175886 5/2008
CN 2010800191297 9/2013

(Continued)

OTHER PUBLICATIONS

International Search Report dated Jul. 20, 2010, issued for PCT/JP2010/057133.

*Primary Examiner* — Zachary Kuhfuss
(74) *Attorney, Agent, or Firm* — Edwards Wildman Palmer LLP; James E. Armstrong, IV; Jonathon P. Western

(57) ABSTRACT

Disclosed is a truck lateral motion restricting device which can prevent a large impact from being applied to a stopper when the truck lateral motion restricting device is operated in the derailment. The device comprises a guard angle (52) which is provided along the inside of the rail (51) and a stopper (25) which projects downward from a more inward position than wheels (15) of the truck (11) and is in slidable contact with the inside surface (52*a*) of the guard angle, wherein the stopper comprises a slidable contact portion (28), which has a slidable contact surface slidable contact with the inside surface of the guard angle, and guide portions (31) which project at front and rear portions of the slidable contact portion and have a front end inclined in a direction separating from the inside surface of the guard angle and a base having a guide slope (31*a*) provided continuously to the slidable contact surface.

7 Claims, 11 Drawing Sheets

(56) References Cited

U.S. PATENT DOCUMENTS

| | | | | |
|---|---|---|---|---|
| 1,490,781 | A * | 4/1924 | Marshall | 105/216 |
| 1,626,610 | A * | 5/1927 | Hornquist | 105/216 |
| 2,319,466 | A * | 5/1943 | McCormick et al. | 104/242 |
| 2,470,662 | A * | 5/1949 | Spencer | 238/19 |
| 4,265,401 | A * | 5/1981 | Jackson | 238/17 |
| 8,261,671 | B2 * | 9/2012 | Sakanoue et al. | 105/216 |
| 2006/0124024 | A1 | 6/2006 | Hachikawa | |
| 2009/0200389 | A1 | 8/2009 | Seki et al. | |
| 2011/0121088 | A1 | 5/2011 | Seki et al. | |
| 2011/0121089 | A1 | 5/2011 | Seki et al. | |

FOREIGN PATENT DOCUMENTS

| | | | | |
|---|---|---|---|---|
| EP | 1995145 | A1 | 11/2008 | |
| EP | 2216440 | A1 | 8/2010 | |
| EP | 10769662.7 | | 2/2014 | |
| FR | 2755658 | A1 * | 5/1998 | B61F 9/00 |
| JP | 57-094567 | | 6/1982 | |
| JP | S57-094567 | | 6/1982 | |
| JP | 3393032 | | 9/1998 | |
| JP | 2005-247312 | A | 9/2005 | |
| JP | 3119047 | U | 1/2006 | |
| JP | 2006-168694 | A | 6/2006 | |
| JP | 2007-176480 | A | 7/2007 | |
| JP | 2009-110619 | | 4/2013 | |
| JP | 2009-110619 | | 8/2013 | |
| TW | 099113655 | | 2/2013 | |
| TW | 099113655 | | 12/2013 | |
| WO | WO-2007/105672 | A1 | 9/2007 | |
| WO | WO-2009/072258 | A1 | 6/2009 | |

* cited by examiner

TRUCK LATERAL MOTION RESTRICTING DEVICE

TECHNICAL FIELD

This invention relates to a truck lateral motion restricting device, and relates particularly to a truck lateral motion restricting device which restricts a lateral motion of a truck when a rolling stock is derailed by earthquake or gust to thereby prevent the occurrence of a secondary disaster.

BACKGROUND ART

In order to prevent derailment of a rolling stock when a lateral load is applied to the rolling stock due to a natural disaster such as earthquake and gust, a guard angle is provided along the inside of a rail. However, in case the rolling stock is unfortunately derailed over the guard angle, there has been proposed a device which guides the rolling stock so that the rolling stock runs on a ballast with sleepers or a roadbed. The device is provided with a guard angle provided along the inside of a rail and a stopper projecting downward at a position more inside than wheels of a truck, and the stopper is in slidable contact with the inside surface of the guard angle in the derailment to restrict a lateral motion of the truck (for example, see Patent Document 1).

PRIOR ART DOCUMENT

Patent Document

Patent Document 1: International Publication WO 2007/105672 pamphlet

SUMMARY OF THE INVENTION

Problems to be Solved by the Invention

In the truck lateral motion restricting device described in the Patent Document 1, although the lateral motion of a truck can be restricted in the derailment, a large impact may be applied to the stopper at a joint of the guard angle, so that a large load may be applied on the stopper, the truck, the carbody, and so on. Since it is difficult to remove the joint of the guard angle in view of maintenance of the guard angle, it is necessary to take measures on the stopper side.

Thus, this invention provides a truck lateral motion restricting device which can prevent a large impact from being applied to a stopper when the truck lateral motion restricting device is operated in the derailment.

Means for Solving the Problems

In order to achieve the above object, the present invention provides a truck lateral motion restricting device for controlling a lateral motion of a truck when a rolling stock running on a pair of left and right rails is derailed, the devise comprising a guard angle which is provided along the inside of the rail and a stopper which projects downward from a more inward position than wheels of the truck and is in slidable contact with the inside surface of the guard angle in case of the derailment to restrict the lateral motion of the truck. In the truck lateral motion restricting device, the stopper is provided with a slidable contact portion, which has a slidable contact surface in slidable contact with the inside surface of the guard angle, and guide portion which project at front and rear portions of the slidable contact portion and have a front end inclined in a direction separating from the inside surface of the guard angle and a base having a guide slope provided continuously to the slidable contact surface.

Further, in the truck lateral motion restricting device of this invention, the stopper has on the both sides of the upper portion of the slidable contact portion a truck support portion having a truck supporting surface which when the slidable contact surface is in slidable contact with the inside surface of the guard angle, is in slidable contact with the upper surface of the guard angle to restrict the downward motion of the truck. The truck support portion is provided with downward guide portions, which project at front and rear portions of the truck support portion and has a front end inclined in a direction separating from the upper surface of the guard angle and a base having a downward guide slope provided continuously to the truck supporting surface.

The stopper is constituted of a stopper body having the slidable contact portion and the guide portion and a stopper mounting member which allows an upper portion of the stopper body to mount so that the up and down positions of the stopper body can be adjusted. The stopper mounting member has at its upper portion a truck mounting portion mounted to a stopper mounting portion of the truck, and the truck mounting portion and the stopper mounting portion have concavoconvex engagement portions, which are engaged with each other when the truck mounting portion is mounted to the stopper mounting portion. The concavoconvex engagement portions are a longitudinal recessed groove which is provided at both side surface portions of one of the stopper mounting portion and the upper portion of the stopper mounting member and a protrusion which projects from both side portions of the other of them to be engaged with the recessed groove.

The upper portion of the stopper body and the stopper mounting member are fixed through a bolt penetrating through a stopper body mounting surface and an abutted surface provided at the upper portion of the stopper body so that the stopper body mounting surface in a sleeper direction of the stopper mounting member and the abutted surface of the stopper body are in surface contact with each other, and the upper portion of the stopper body and the stopper mounting member are longitudinally overlapped with each other. A vertical position of the bolt of the abutted surface is set to a position where a tensile load applied to the bolt by a longitudinal load applied to the lower portion of the stopper body in the derailment is the same tensile load as a forward load and a backward load.

Effect of the Invention

According to a truck lateral motion restricting device of this invention, since guide portions each having a guide slope project at front and rear portions of a slidable contact portion having a slidable contact surface which is in slidable contact with the inside surface of a guard angle, a large impact is not applied at a joint of the guard angle, and a truck and carbody can be protected.

MODE FOR CARRYING OUT THE INVENTION

Figure 1:
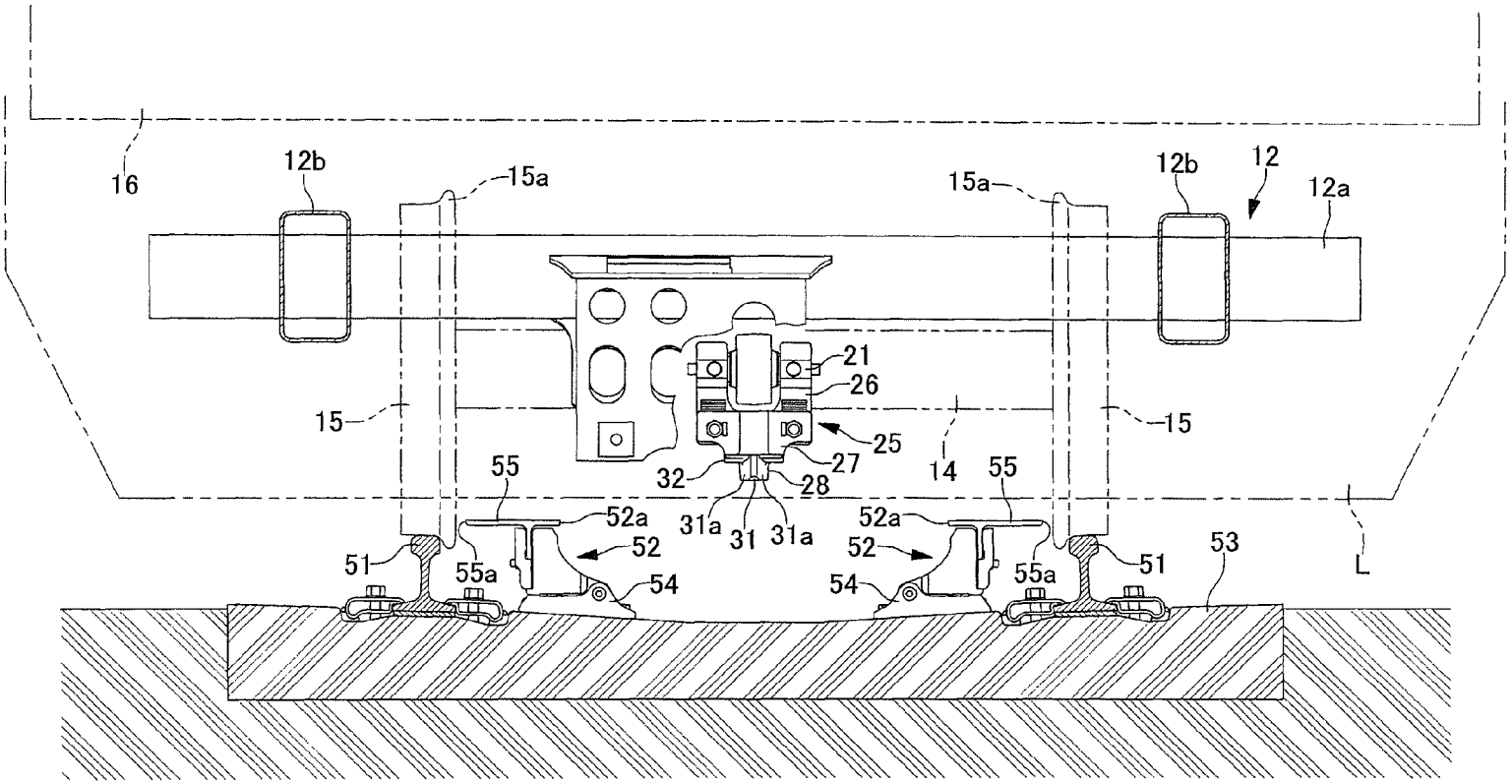
FIG. 1 is a schematic cross-sectional front view of a truck to which a first embodiment of a truck lateral motion restricting device of this invention is applied.
Figure 2:
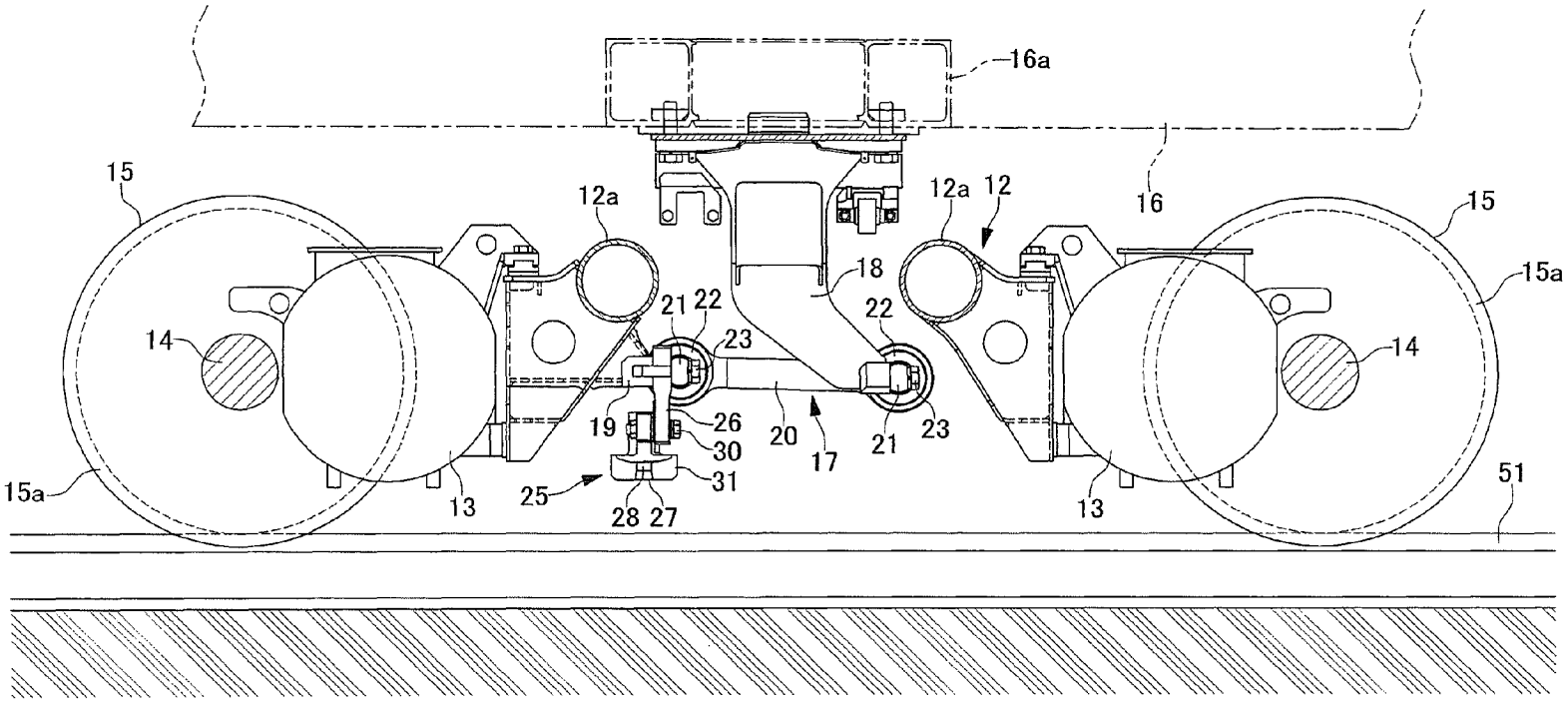
FIG. 2 is a schematic cross-sectional side view of the truck.
Figure 3:
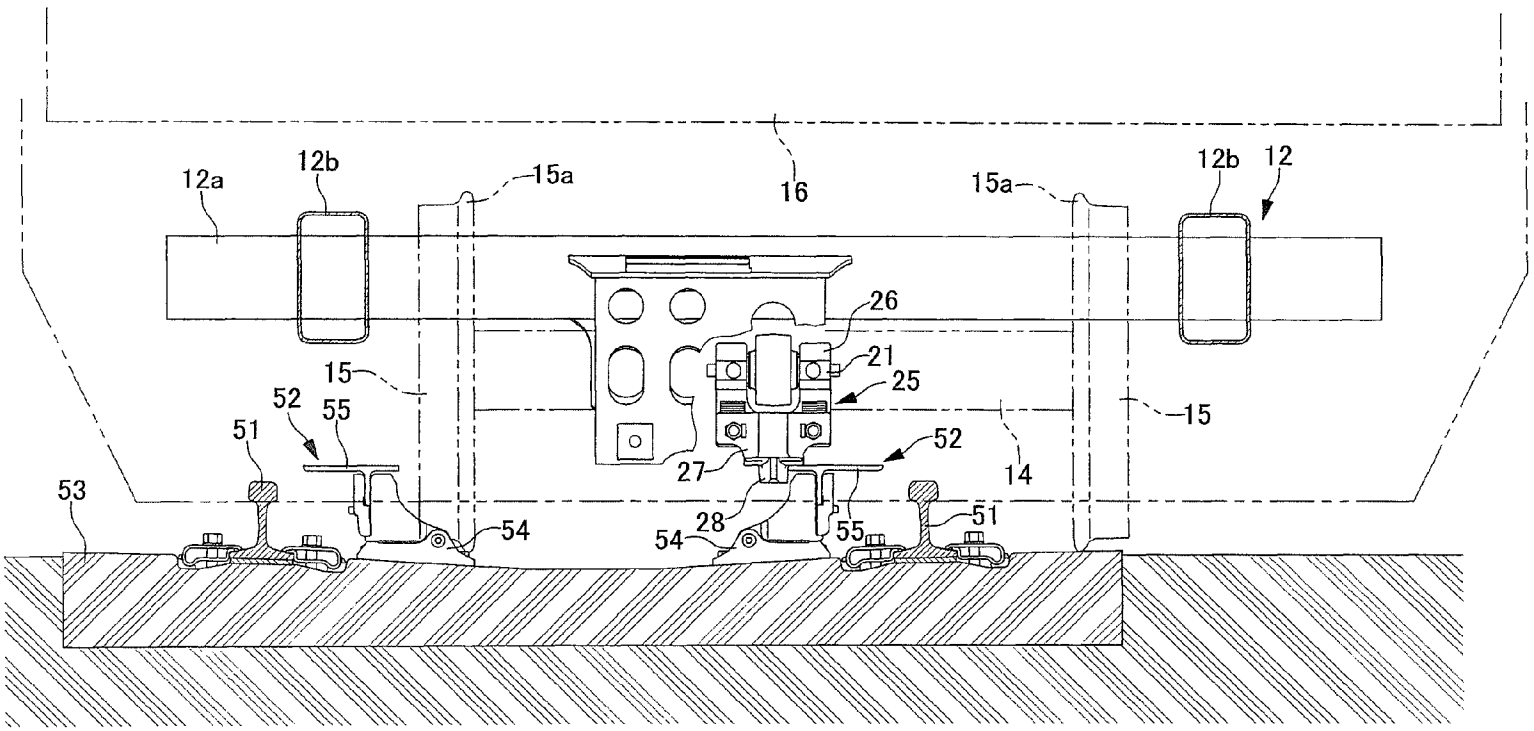
FIG. 3 is a schematic cross-sectional front view of the truck showing a state at the time of derailment.
Figure 4:
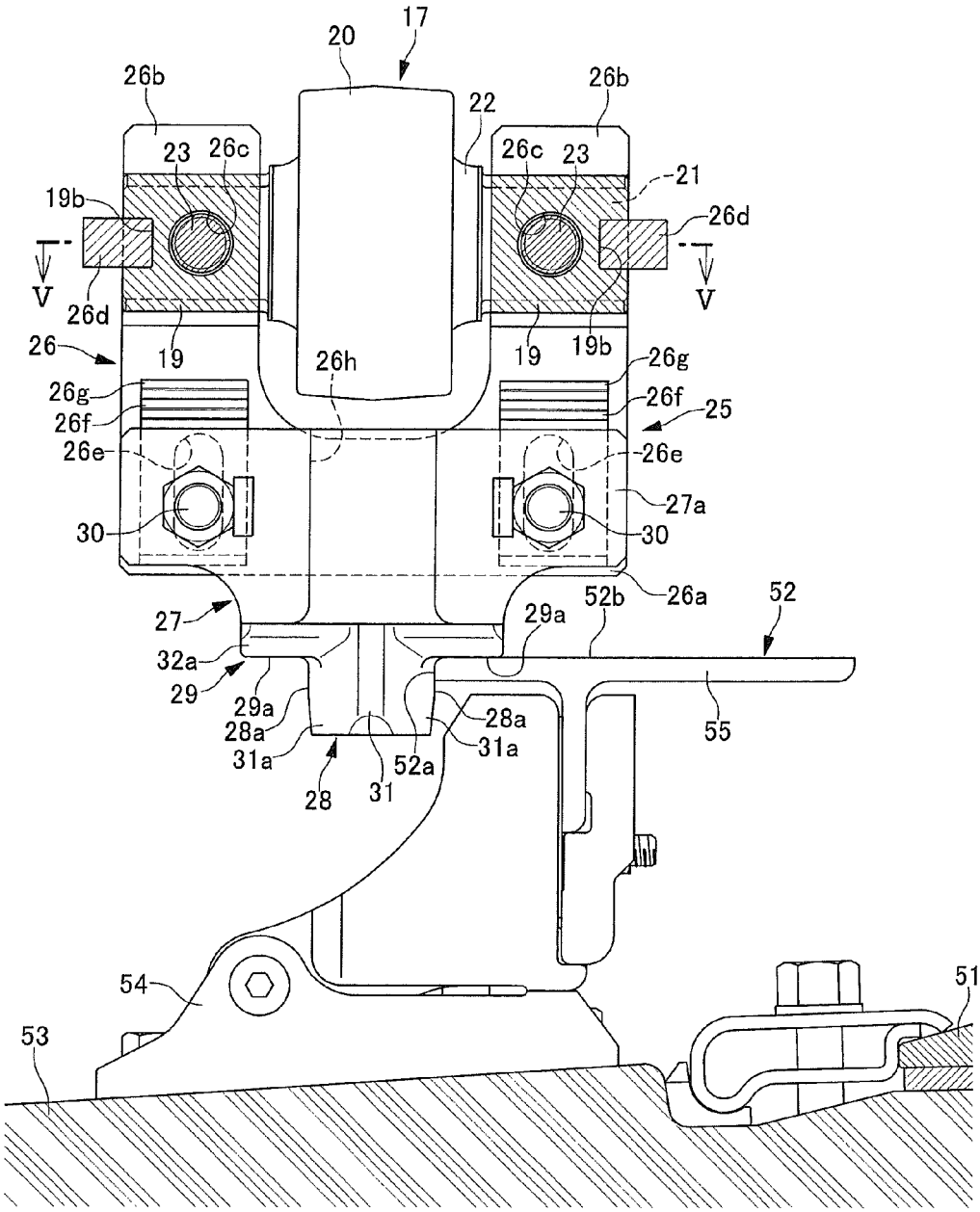
FIG. 4 is a partially sectional front view of a relevant portion of the truck showing the state at the time of derailment.
Figure 5:
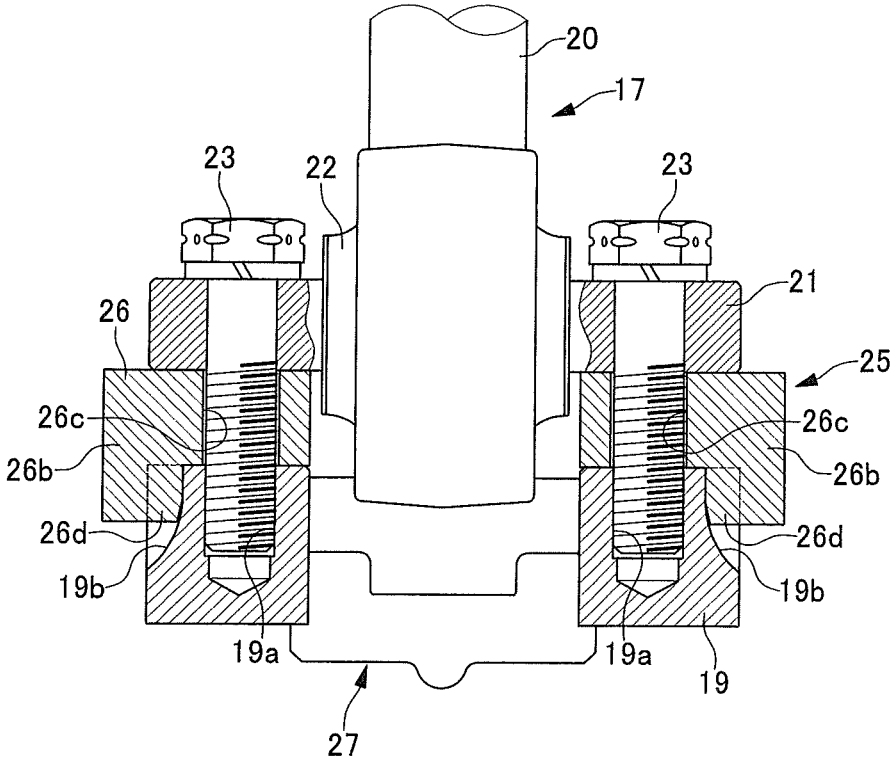
FIG. 5 is a V-V cross-sectional view of FIG. 4.
Figure 6:
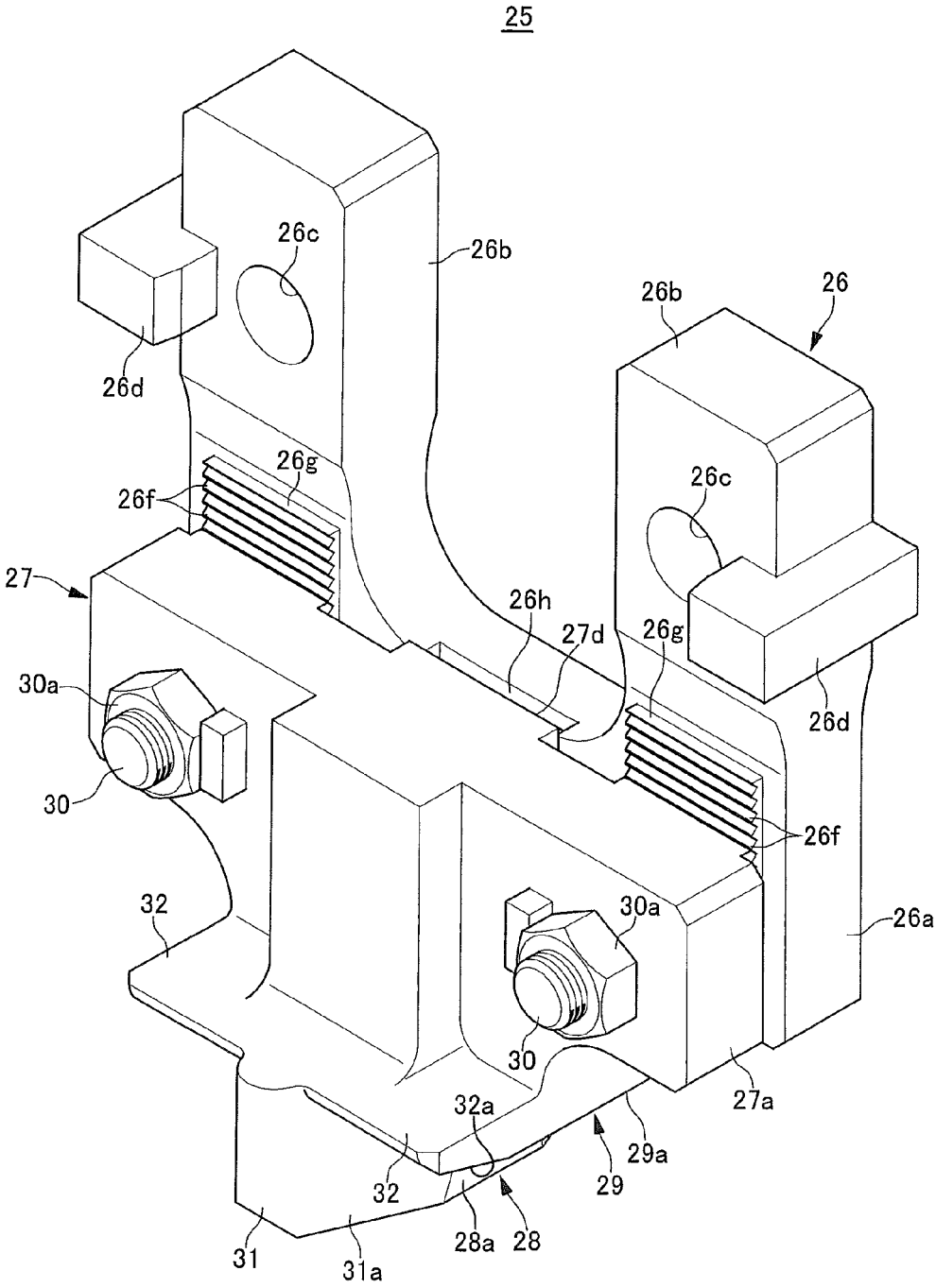
FIG. 6 is a perspective view of a stopper of the truck.

A truck 11 of the present embodiment is a bolsterless truck for motor cars. A traction motor 13 is fixed to a cross beam 12*a* of a truck frame 12. The rotational force of the traction motor 13 is transmitted to a wheelset 14 and a wheel 15 through a flexible coupling and a gear unit. A side beam 12*b* of the truck frame has at its both ends an axle box suspension and an axle box for supporting the both ends of the wheelset 14 and brake equipment. A carbody 16 is placed on the truck frame 12 through a secondary suspension, and the truck 11 and the carbody 16 are coupled with each other by a traction device 17 for transmitting a drive force and a braking force.

The traction device 17 is of a single link type in which a carbody-side link support 18 provided at the lower portion of an underframe 16*a* of the carbody 16 and a truck-side link support 19 provided at one cross beam 12*a* are coupled with each other through a single link 20. The both ends of the link 20 are formed into a ring shape, and a rubber bush 22 provided with a horizontal shaft portion 21 is fitted into the ring-shaped portion. The shaft portions 21 projecting at the both sides of the rubber bush 22 are fixed to the link supports 18 and 19 by bolts 23 respectively.

A stopper 25 projecting downward is mounted to the truck-side link support 19. The stopper 25 is constituted of a stopper mounting member 26 fixed to the truck-side link support 19 as a stopper mounting portion and a stopper body 27 mounted to the lower portion of the stopper mounting member 26. The stopper mounting member 26 is formed into a U shape in which mounting arms 26*b* are provided upright on the both sides of a horizontal base 26*a*. The distance between the mounting arms 26*b* is slightly larger than the width dimension of the rubber bush 22.

The mounting arms 26*b*, which are truck mounting portions, each have in its upper portion a bolt hole 26*c* into which the bolt 23 is inserted. Further, the mounting arms 26*b* each have at its upper side portion a protrusion 26*d* engaged with a longitudinal recessed groove 19*b* provided on the both side surfaces of the truck-side link support 19. The protrusion 26*d* projects toward the truck-side link support 19. The base 26*a* of the stopper mounting member 26 has on its both side portions a vertically elongated bolt insertion long hole 26*e*. Further, in the stopper mounting member 26, rectangular stopper body fixing portions 26*g* are each projectingly provided on the surface on the stopper body mounting side and each have a concavoconvex engagement portion 26*f* on the projection end surface of the stopper body fixing portion 26*g*. The surface on the stopper body mounting side of the central portion of the base 26*a* has a vertical engagement recessed groove 26*h*.

The stopper body 27 is configured so that a slidable contact portion 28 and a truck support portion 29 are integrally provided at the lower portion of a horizontal base 27*a*. Concavoconvex engagement portions 27*b* engaged with the concavoconvex engagement portions 26*f* are provided on the surfaces on the stopper mounting member 26 side of the both ends of the base 27*a*. A bole hole 27*c* into which a bolt 30 is inserted is provided at a position corresponding to the bolt insertion long hole 26*e*. The stopper body 27 is mounted to the stopper mounting member 26 through the bolt 30. A vertical engagement protrusion 27*d* engaged with the engagement recessed groove 26*h* is provided at the central portion on the stopper mounting member 26 side of the upper portion of the stopper body 27.

The lower portion of the stopper mounting member 26 and the upper portion of the stopper body 27 are fixed by fastening the bolt 30, penetrating through the bolt insertion long hole 26*e* and the bolt hole 27*c*, with a nut 30*a* so that the concavoconvex surfaces of the concavoconvex engagement portions 26*f* and 27*b* are abutted against each other at a predetermined vertical position to be engaged with each other, the engagement recessed groove 26*h* and the engagement protrusion 27*d* are engaged with each other, and the lower portion of the stopper mounting member 26 and the upper portion of the stopper body 27 are longitudinally overlapped with each other.

The vertical position of the bolt 30 in the state that the stopper mounting member 26 and the stopper body 27 are fixed is set to a position where a tensile load applied to the bolt 30 by a longitudinal load applied to the slidable contact portion 28 and the truck support portion 29 of the lower portion of the stopper body 27 is the same tensile load as a forward load and a backward load.

Figure 7:
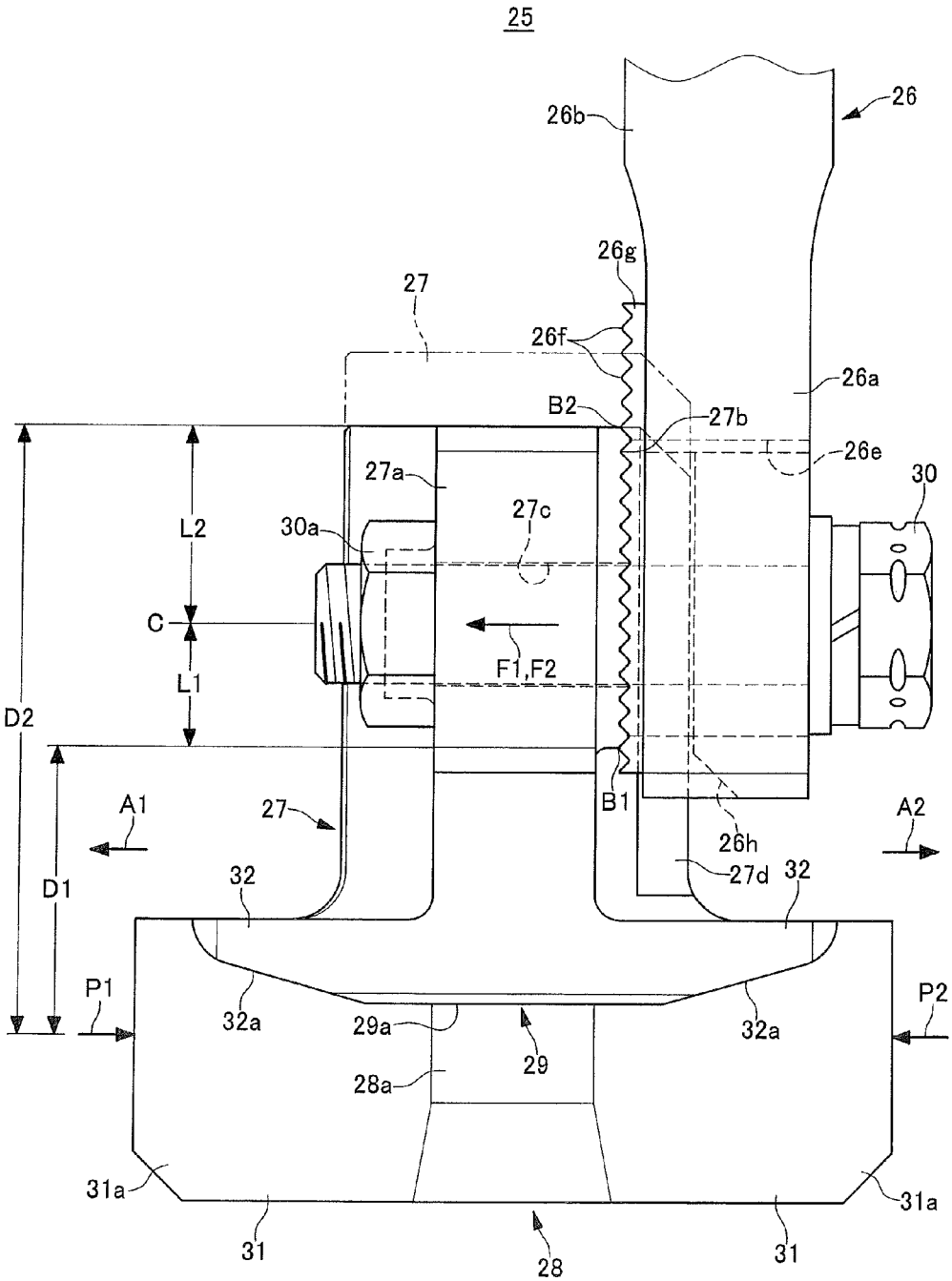
FIG. 7 is a side view of a relevant portion of the stopper.

Namely, in FIG. 7, if derailment occurs when a rolling stock runs in an arrow A1 direction, a load P1 from a front portion of the stopper body 27 is applied to the lower portion of the stopper body 27 (the slidable contact portion 28 and the truck support portion 29). The load P1 is applied as a tensile load F1 to the bolt 30 with a lower end B1 of the abutted surface of the concavoconvex engagement portions 26*f* and 27*b* as a fulcrum. Meanwhile, if derailment occurs when the rolling stock runs in an arrow A2 direction, a load P2 from a rear portion of the stopper body 27 is applied. The load P2 is applied as a tensile load F2 to the bolt 30 with an upper end B2 of the abutted surface of the concavoconvex engagement portions 26*f* and 27*b* as a fulcrum.

The tensile load F1 applied to the bolt 30 when the load P1 is applied from the front portion and the tensile load F2 applied to the bolt 30 when the load P2 is applied from the rear portion are respectively obtained by formulae: $F1=(P1\times D1)/L1$ and $F2=(P2\times D2)/L2$. L1 in the formula represents a distance between a center line C of the bolt 30 and the lower end B1 of the abutted surface. L2 represents a distance between the center line C of the bolt 30 and the upper end B2 of the abutted surface. D1 represents a distance between the application points of the loads P1 and P2 and the lower end B1 of the abutted surface (a distance in a direction perpendicular to the center line C). D2 represents a distance between the application points of the loads P1 and P2 and the upper end B2 of the abutted surface (a distance in a direction perpendicular to the center line C).

When the loads P1 and P2 from the front and rear portions are assumed to be the same from conditions including the running speed of a rolling stock, in order to make the tensile loads F1 and F2 applied to the bolt 30 the same value, (P1×D1)/L1 may be (P2×D2)/L2. Since P1=P2, D1/L1 may be D2/L2. The vertical position of the bolt 30 to the abutted surface of the concavoconvex engagement portions 26*f* and 27*d* is set thus, whereby the tensile loads F1 and F2 applied to the bolt 30 can be made the same value regardless the running direction of the rolling stock.

According to the above constitution, tension strength of the bolt 30 can be optimized, and, in addition, the strength of the bolts 23 and 28 can be set so that the bolt 30 for fixing the stopper body 27 to the stopper mounting member 26 is broken before the bolt 23 for fixing the shaft portion 21 of the link 20 and the stopper 25 to the truck-side link support 19 is broken. Consequently, even if an excessive longitudinal load is applied to the stopper body 27 in the derailment, it can be reliably prevented that the bolt 23 is broken to drop the shaft portion 21 from the truck-side link support 19, and, thus, to separate the truck 11 and the carbody 16.

The slidable contact portion 28 has on its both side surfaces a vertical slidable contact surface 28*a* which is provided along the inside of left and right rails 51 and is in slidable contact with an inside surface 52*a* of a guard angle 52. The slidable contact portion 28 further has projecting guide portions 31 provided at the front and rear portions of the slidable contact portion 28. In the guide portion 31, the front end is inclined in a direction gradually separating from the inside surface 52*a* of the guard angle 52, and the base has at each of its front and rear portions of the both side surfaces a sideways guide slope 31*a* provided continuously to the slidable contact surface 28*a*.

The truck support portion 29 is provided at upper both side portions of the slidable contact portion 28. The truck support portion 29 has a truck supporting surface 29*a* which when the slidable contact surface 28*a* is slidable contact with the inside surface 52*a* of the guard angle 52, is slidable contact with the upper surface 52*b* of the guard angle 52 to restrict the downward motion of the truck 11. The truck support portion 29 further has downward guide portions 32 projecting the front and rear portions of the truck support portion 29. In the downward guide portion 32, the front end is inclined in a direction gradually separating from the upper surface 52*b* of the guard angle 52, and the base has at each of its front and rear portions of the lower surface a downward guide slope 32*a* provided continuously to the truck supporting surface 29*a*.

The stopper 25 formed as above is mounted to the truck-side link support 19 by the bolt 23 along with the shaft portion 21 of the link 20 in such a state that the protrusion 26*d* of the stopper mounting member 26 is engaged with the recessed groove 19*b* of the truck-side link support 19, so that the stopper 25 is in a state of projecting downward from a more inward position than the wheels 15 of the truck 11.

Meanwhile, on the track side, the guard angle 52 is provided along the inside of the left and right rails 51. The guard angle 52 is constituted of a fixing member 54 attached to a concrete roadbed of a slab track or a sleeper 53 of a ballasted track and a T-shaped guard member 55 attached to an upper portion of the fixing member 54. The height of the guard member 55 is set so as to be on the same plane as the upper surface of the rail 51 or slightly higher than the upper surface of the rail 51.

The wheels 15 are floated due to a shake of an earthquake, and when a flange 15*a* of one wheel 15 is to traverse the rail 51, the inside surface of the other wheel 15 is in slidable contact with a rail side portion 55*a* of the guard member 55, whereby the rail side portion 55*a* prevents the other wheel 15 from derailing inward the track and prevents the flange 15*a* of one wheel 15 from traversing the rail 51. Consequently, the wheels 15 are prevented from being derailed from the rail 51 without interfering with the running of a rolling stock.

The flange 15*a* of one wheel 15 traverses the rail 51 due to a large shake, and when the other wheel 15 traverses the guard angle 52 to be derailed, the slidable contact surface 28*a* of the slidable contact portion 28 is in slidable contact with the inside surface 52*a* of the guard angle 52 located inside the track, whereby the inside surface 52*a* restricts the truck 11 to be further moved in the derailing direction without interfering with the running of a rolling stock. The truck supporting surface 29*a* of the truck support portion 29 is in slidable contact with the upper surface 52*b* of the guard angle 52 to thereby suppress the flange 15*a* of the wheel 15 to violently collide with the sleeper 53 and the fixing member 54. Further, the front end of the guide portion 31 is prevented from violently colliding with the fixing member 54. The slidable contact surface 28*a* of the slidable contact portion 28 is in slidable contact with the inside surface 52*a*, whereby force to fall in the direction of the rail 51 is applied to the guard member 55. However, the truck supporting surface 29*a* is in slidable contact with the upper surface 52*b*, resulting in such a state that the truck supporting surface 29*a* presses downward the inside surface 52*a* side of the guard member 55, whereby the guard member 55 can be prevented from falling in the rail direction.

By virtue of the provision of the guide portion 31 having the guide slope 31*a* and the downward guide portion 32 having the downward guide slope 32*a*, even when rail misalignment occurs at a joint portion of the guard member 55, the slidable contact portion 28 and the truck support portion 29 can be prevented from colliding with the joint by the guide slope 31*a* and the downward guide slope 32*a*. Therefore, a large impact is not applied from a rail misalignment portion at a joint, so that the stopper 25 can be prevented from being broken by the impact, and, at the same time, a truck and a carbody can be prevented from being broken.

The slidable contact surface 28*a* is in slidable contact with the inside surface 52*a* of the guard angle 52, whereby a horizontal force and a rotational force are applied to the stopper body 27. However, the engagement recessed groove 26*h* and the engagement protrusion 27*d* are engaged with each other, and the concavoconvex engagement portions 26*f* and 27*b* are engaged with each other; therefore, positional deviation between the stopper mounting member 26 and the stopper body 27 does not occur, and a shear force is not applied to the bolt 30. Likewise, since the recessed groove 19*b* and the protrusion 26*d* are engaged at the upper portion of the stopper 25, the positional deviation between the truck-side link support 19 and the stopper mounting member 26 can be prevented, and the shear force is not applied to the bolt 23. Consequently, the bolts 23 and 30 can be protected from breakage.

Since the stopper mounting member 26 has the bolt insertion long hole 26*e*, the up and down positions of the stopper body 27 can be easily adjusted. When the wheel diameter is reduced by grinding of the wheel 15, the mounting position of the stopper body 27 to the stopper mounting member 26 is changed upward, whereby the stopper body 27 does not project downward beyond a rolling stock gauge L.

Accordingly, since the lateral motion of the derailed truck 11 is restricted, derailment outward the track and overturning of the rolling stock can be prevented, and a secondary disaster caused by the derailment can be prevented. In addition, not only the stopper 25 but also the truck 11 and the carbody 16 can be prevented from being damaged by impact.

The dimension and the inclination angle of the guide slopes 31*a* and 32*a* can be suitably set according to the state of the stagger of the guard member 55 and the conditions including the speed of the rolling truck, and a portion of or the whole inclined surface may be a circular-arc surface or a spherical surface. It is preferable that the size of the stopper 25, and particularly the lateral width of the slidable contact portion 28 and the position of the inside surface 52*a* of the guard angle 52 are, as described in the Patent Document 1, set to approximately ½ of an interval between the carbodies 16 of a train running at a double track portion. When derailment occurs, the lower surface of the traction motor 13 of the truck 11 is in slidable contact with the upper surfaces of the guard angle 52 and the rail 51, so that when the downward motion of the truck 11 can be restricted, the truck support portion 29 can be omitted.

Figure 8:
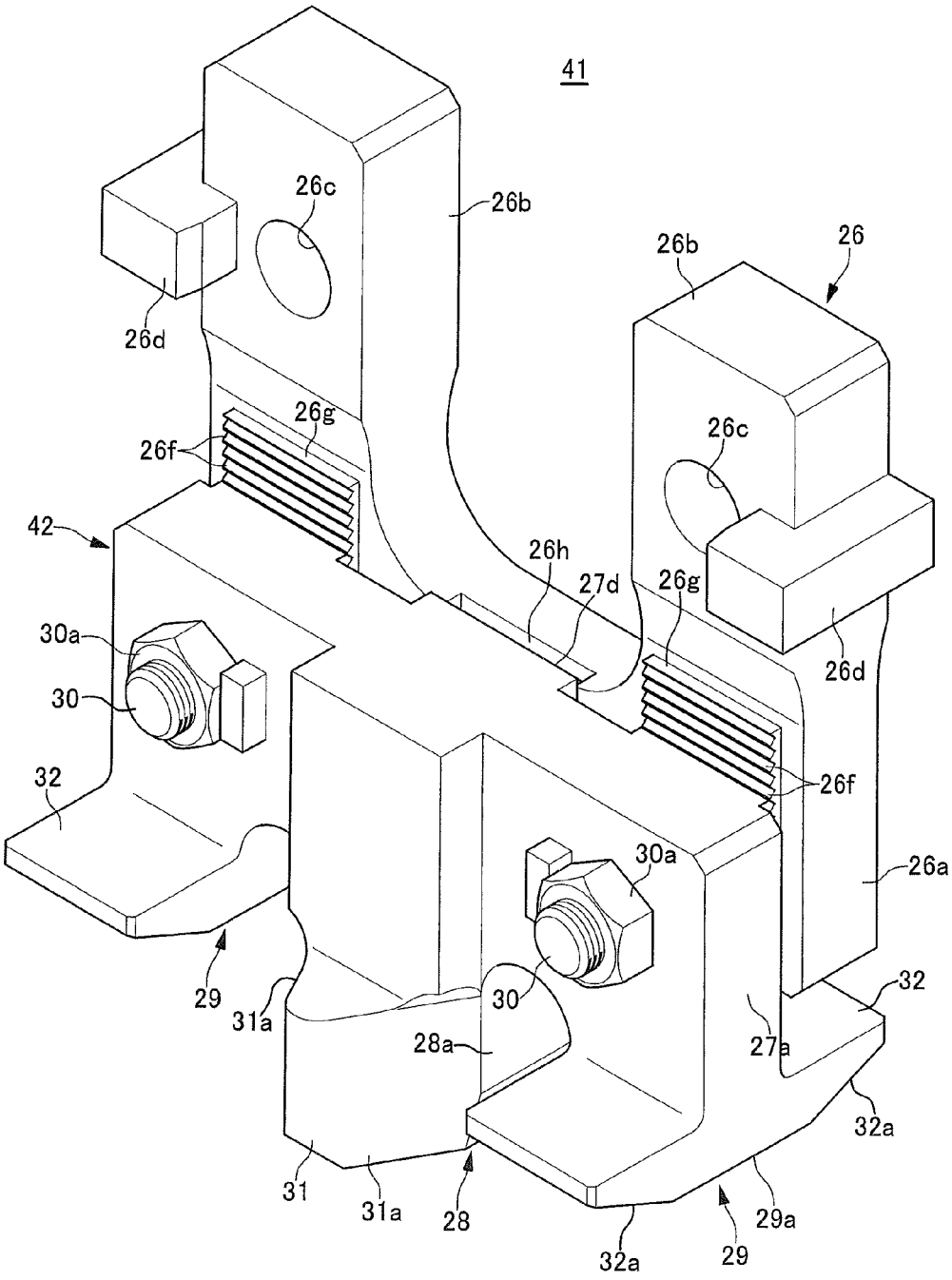
FIG. 8 is a perspective view of a stopper in a second embodiment of a truck lateral motion restricting device of this invention.

FIG. 8 shows a second embodiment of a stopper. In the following description, the same components as those of each embodiment are represented by the same numbers, and the detailed description will be omitted. In a stopper 41 of the present embodiment, truck support portions 29 provided on the both sides of the upper portion of a slidable contact portion 28 of a stopper body 42 are provided independently from the slidable contact portion 28.

Figure 9:
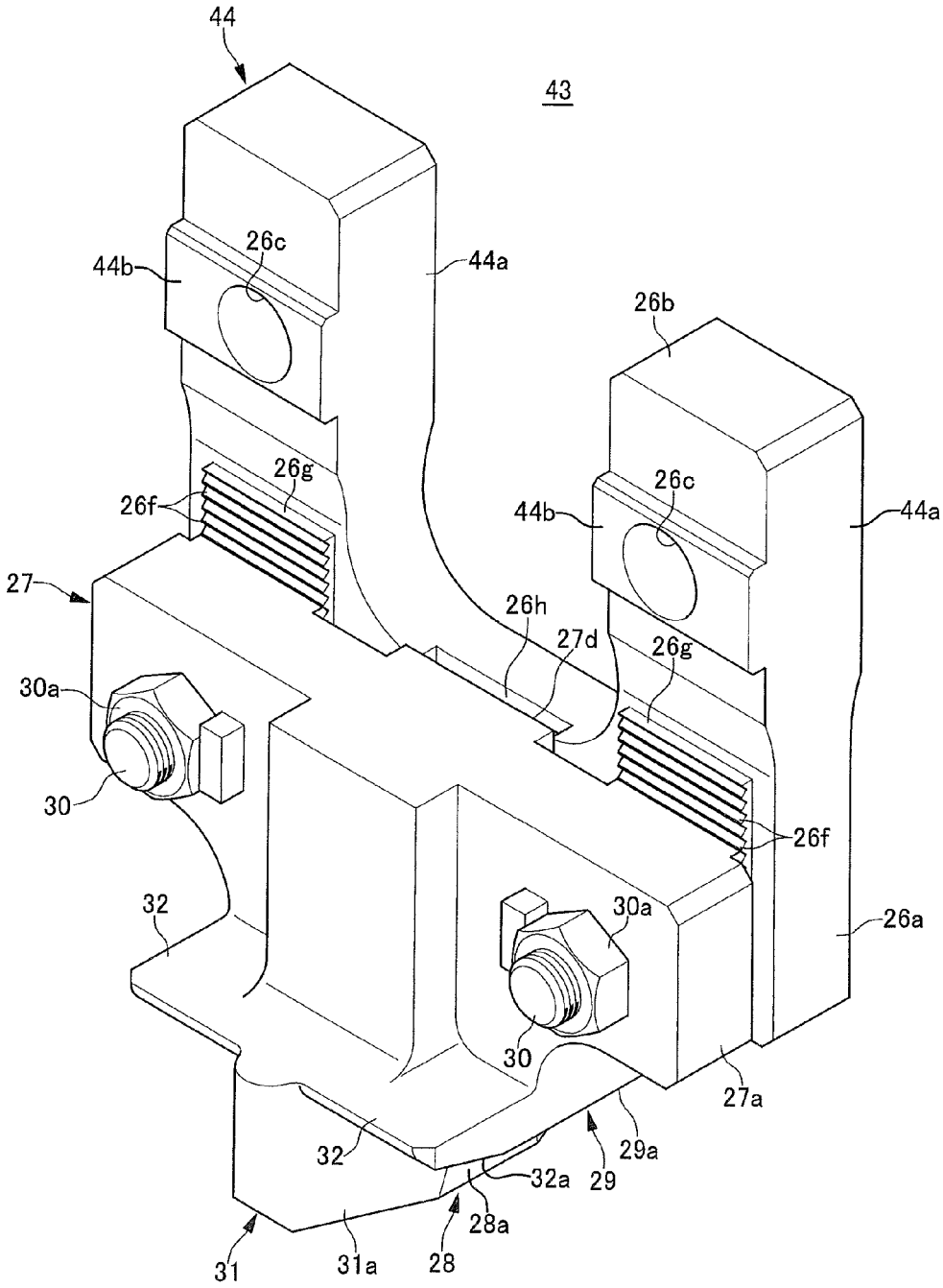
FIG. 9 is a perspective view of a stopper in a third embodiment of a truck lateral motion restricting device of this invention.
Figure 10:
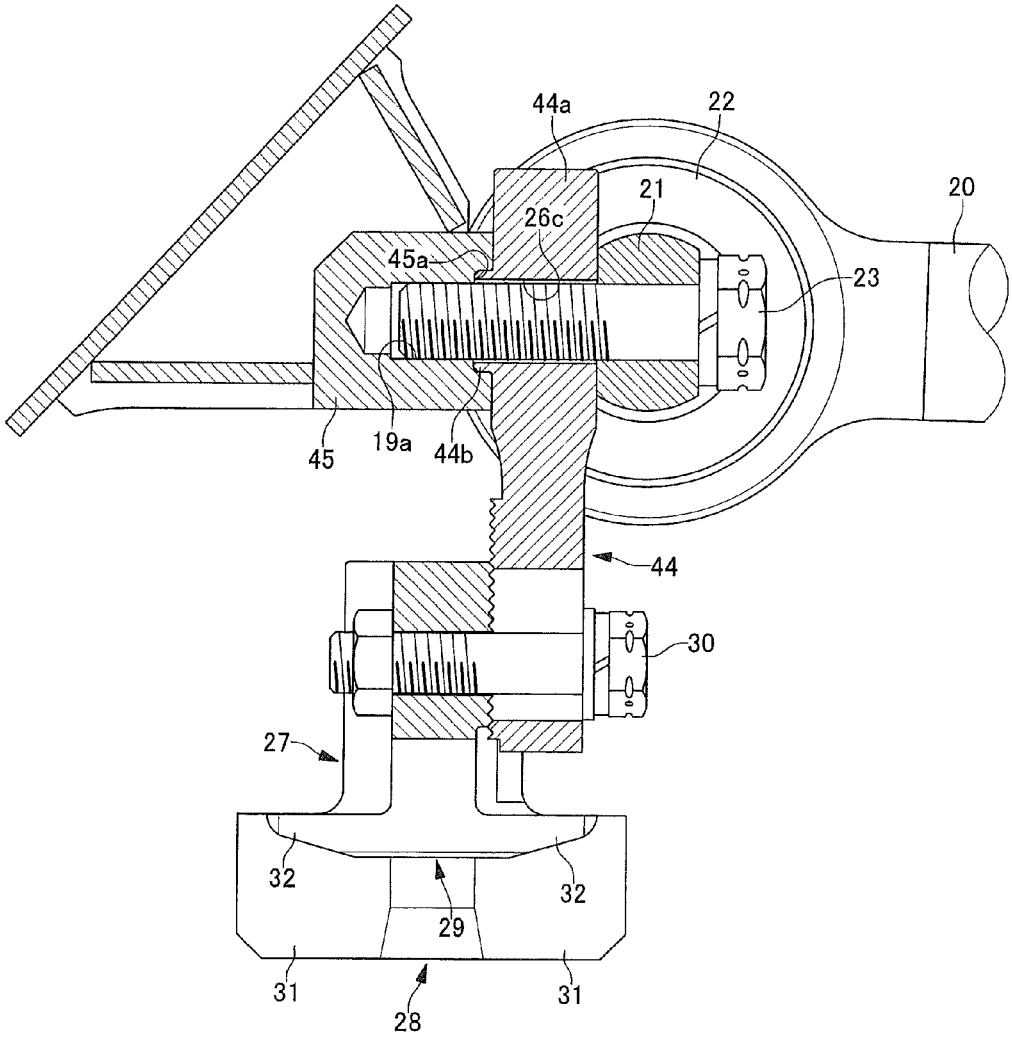
FIG. 10 is a partially sectional side view of the stopper in the third embodiment.

FIGS. 9 and 10 show a third embodiment of a stopper. In a stopper 43 of the present embodiment, concavoconvex engagement portions 44*b* and 45*a* are provided on the opposed surface of a mounting arm 44*a* of a stopper mounting member 44 and a truck-side link support 45, and the concavoconvex engagement portions 44*b* and 45*a* are engaged with each other to thereby prevent a shear force from being applied to a bolt 23.

Figure 11:
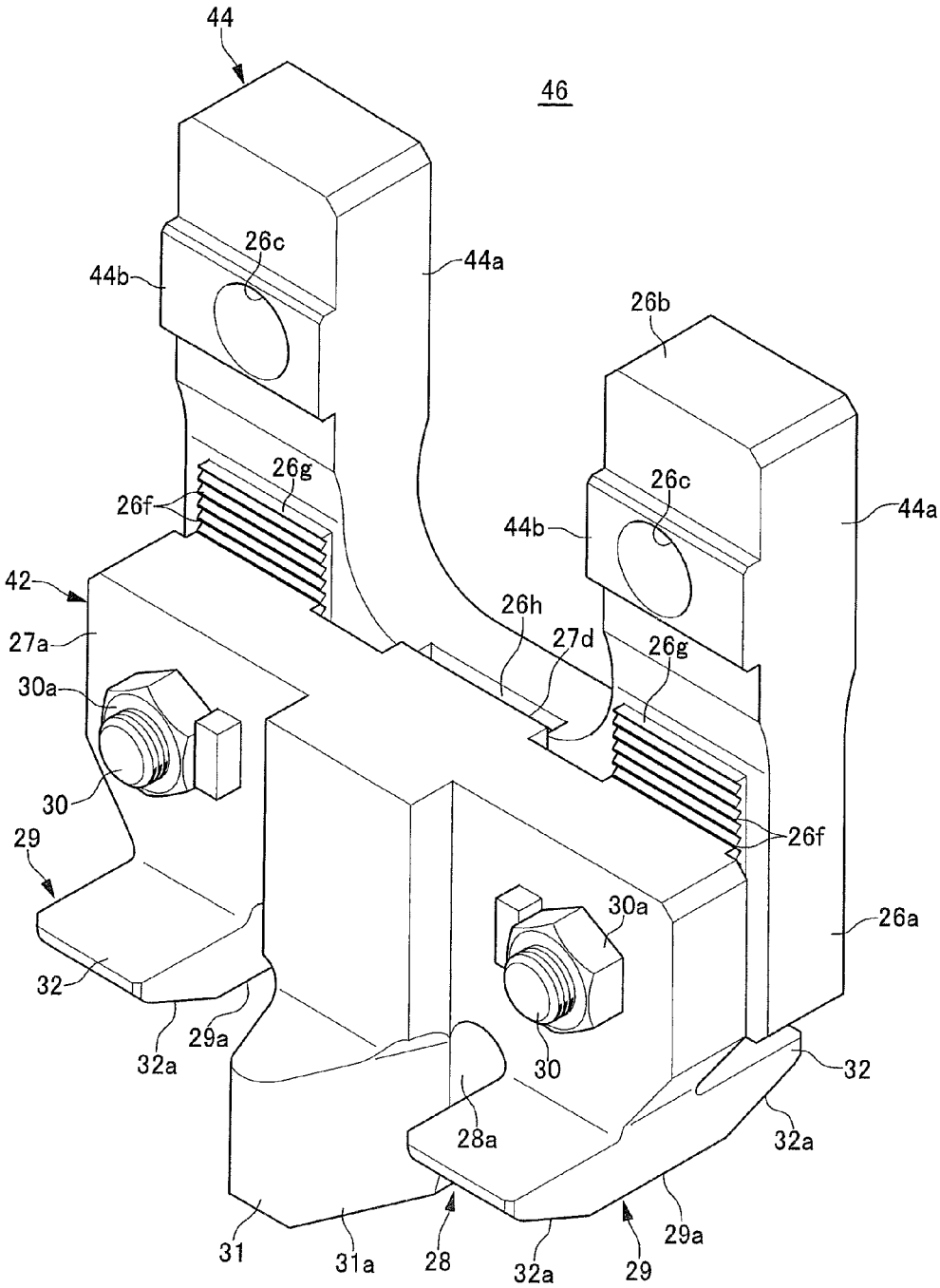
FIG. 11 is a perspective view of a stopper in a fourth embodiment of a truck lateral motion restricting device of this invention.

FIG. 11 shows a third embodiment of a stopper. In a stopper 46 of the present embodiment, as in the second embodiment, a truck support portion 29 provided on the both sides of the upper portion of a slidable contact portion 28 of a stopper body 42 is provided independently from a slidable contact portion 28. Further, as in the third embodiment, each surface on a truck-side link support side of a stopper mounting member 44 has a concavoconvex engagement portion 44*b*.

EXPLANATION OF REFERENCES

11 Truck
12 Truck frame
12*a* Cross beam
12*b* Side beam
13 Traction motor
14 Wheelset
15 Wheel
15*a* Flange
16 Carbody
16*a* Underframe
17 Traction device
18 Carbody-side link support
19 Truck-side link support
19*a* Female threaded hole
19*b* Recessed groove
20 Link
21 Shaft portion
21*a* Bolt hole
22 Rubber bush
23 Bolt
25 Stopper
26 Stopper mounting member
26*a* Base
26*b* Mounting arm
26*c* Bolt hole
26*d* Protrusion
26*e* Bolt insertion long hole
26*f* Concavoconvex engagement portion
26*g* Stopper body mounting portion
26*h* Engagement recessed groove
27 Stopper body
27*a* Base
27*b* Concavoconvex engagement portion
27*c* Bolt hole
27*d* Engagement protrusion
28 Slidable contact portion
28*a* Slidable contact surface
29 Truck support portion
29*a* Truck supporting surface
30 Bolt
30*a* Nut
31 Guide portion
31*a* Guide slope
32 Downward guide portion
32*a* Downward guide slope
51 Rail
52 Guard angle
52*a* Inside surface
52*b* Upper surface
53 Sleeper
54 Fixing member
55 Guard member
55*a* Rail-side portion

What is claimed is:

1. A truck lateral motion restricting device for controlling a lateral motion of a truck when a rolling stock running on a pair of left and right rails is derailed, comprising:

a guard angle which is provided along the inside of the rail; and a stopper which projects downward from a more inward position than wheels of the truck and is in slidable contact with the inside surface of the guard angle in case of the derailment to restrict the lateral motion of the truck, wherein the stopper comprises a slidable contact portion, which has a slidable contact surface in slidable contact with the inside surface of the guard angle, and guide portions which project at front and rear portions of the slidable contact portion and have a front end inclined in a direction separating from the inside surface of the guard angle and a base having a guide slope provided continuously to the slidable contact surface, wherein the stopper comprises on the both sides of the upper portion of the slidable contact portion a truck support portion having a truck supporting surface which when the slidable contact surface is in slidable contact with the inside surface of the guard angle, is in slidable contact with the upper surface of the guard angle to restrict the downward motion of the truck, and wherein the truck support portion comprises downward guides portion, which project at front and rear portions of the truck support portion and have a front end inclined in a direction separating from the upper surface of the guard angle and a base having a downward guide slope provided continuously to the truck supporting surface.

2. The truck lateral motion restricting device according to claim 1, wherein the stopper is constituted of a stopper body having the slidable contact portion and the guide portion and a stopper mounting member which allows an upper portion of the stopper body to mount so that up and down positions of the stopper body can be adjusted.

3. The truck lateral motion restricting device according to claim 2, wherein the stopper mounting member has at an upper portion thereof a truck mounting portion mounted to a stopper mounting portion of the truck, and the truck mounting portion and the stopper mounting portion have concavoconvex engagement portions, which are engaged with each other when the truck mounting portion is mounted to the stopper mounting portion.

4. The truck lateral motion restricting device according to claim 3, further comprising: a longitudinal recessed groove which is provided at both side surface portions of one of the stopper mounting portion and the upper portion of the stopper mounting member and a protrusion which projects from both side portions of the other of them to be engaged with the recessed groove.

5. The truck lateral motion restricting device according to claim 4, wherein the upper portion of the stopper body and the stopper mounting member are fixed through a bolt penetrating through a stopper body mounting surface and an abutted surface provided at the upper portion of the stopper body so that the stopper body mounting surface in a sleeper direction of the stopper mounting member and the abutted surface of the stopper body are in surface contact with each other, and the upper portion of the stopper body and the stopper mounting member are longitudinally overlapped with each other, and a vertical position of the bolt of the abutted surface is set to a position where a tensile load applied to the bolt by a longitudinal load applied to the lower portion of the stopper body in the derailment is the same tensile load as a forward load and a backward load.

6. The truck lateral motion restricting device according to claim 3, wherein the upper portion of the stopper body and the stopper mounting member are fixed through a bolt penetrating through a stopper body mounting surface and an abutted surface provided at the upper portion of the stopper body so that the stopper body mounting surface in a sleeper direction of the stopper mounting member and the abutted surface of the stopper body are in surface contact with each other, and the upper portion of the stopper body and the stopper mounting member are longitudinally overlapped with each other, and a vertical position of the bolt of the abutted surface is set to a position where a tensile load applied to the bolt by a longitudinal load applied to the lower portion of the stopper body in the derailment is the same tensile load as a forward load and a backward load.

7. The truck lateral motion restricting device according to claim 4, wherein the upper portion of the stopper body and the stopper mounting member are fixed through a bolt penetrating through a stopper body mounting surface and an abutted surface provided at the upper portion of the stopper body so that the stopper body mounting surface in a sleeper direction of the stopper mounting member and the abutted surface of the stopper body are in surface contact with each other, and the upper portion of the stopper body and the stopper mounting member are longitudinally overlapped with each other, and a vertical position of the bolt of the abutted surface is set to a position where a tensile load applied to the bolt by a longitudinal load applied to the lower portion of the stopper body in the derailment is the same tensile load as a forward load and a backward load.

* * * * *